US007870942B2

(12) United States Patent
Imai et al.

(10) Patent No.: US 7,870,942 B2
(45) **Date of Patent: *Jan. 18, 2011**

(54) COIN-ROLL STORAGE

(75) Inventors: Mikito Imai, Ako (JP); Yumiko Imai, legal representative, Ako (JP); Hiroshi Tone, Tokyo-To (JP); Ryuichi Tabata, Yokohama (JP); Koichi Nishida, Tokyo-To (JP); Kazuyuki Shimizu, Yashio (JP)

(73) Assignee: Glory Ltd., Hyogo-ken (JP)

( * ) Notice: Subject to any disclaimer, the term of this patent is extended or adjusted under 35 U.S.C. 154(b) by 246 days.

This patent is subject to a terminal disclaimer.

(21) Appl. No.: 12/223,805

(22) PCT Filed: Feb. 2, 2007

(86) PCT No.: PCT/JP2007/051801

§ 371 (c)(1),
(2), (4) Date: Aug. 11, 2008

(87) PCT Pub. No.: WO2007/094180

PCT Pub. Date: Aug. 23, 2007

(65) Prior Publication Data

US 2009/0166227 A1 Jul. 2, 2009

(30) Foreign Application Priority Data

Feb. 15, 2006 (JP) ..... 2006-038242

(51) Int. Cl.
*G07D 7/00* (2006.01)

(52) U.S. Cl. ..... 194/302; 194/217; 194/320; 194/334; 453/1; 453/2; 453/16; 453/58; 453/61; 221/196; 221/263; 700/236; 700/242; 700/244; 700/231

(58) Field of Classification Search ..... 194/215–17, 194/302, 320, 334, 335; 453/1, 2, 16, 17, 453/58–62; 221/6, 129, 131, 132, 196, 263; 700/231, 232, 236, 237, 240–244
See application file for complete search history.

(56) References Cited

U.S. PATENT DOCUMENTS 7,591,361 B2 * 9/2009 McGunn et al. ..... 194/216

(Continued)

FOREIGN PATENT DOCUMENTS

JP 5-303672 11/1993

(Continued)

OTHER PUBLICATIONS

English translation of International Preliminary Report issued in PCT/JP2007/051801 dated Aug. 28, 2008.

*Primary Examiner*—Jeffrey A Shapiro
(74) *Attorney, Agent, or Firm*—Smith, Gambrell & Russell, LLP

(57) ABSTRACT

A coin-roll storage 1 comprises a storage body 1*a* and a coin-roll drawer 11 (12, 13) having a plurality of coin-roll storage portions 14 provided therein, each coin-roll storage portion 14 being adapted for storing one coin roll therein. Each coin-roll storage portion 14 of the coin-roll drawer 11 (12, 13) is adapted for storing therein the coin roll of any denomination. A determination unit 16 is adapted for determining the denomination of each coin roll by detecting an outer diameter, an axial length and material of the coin roll.

7 Claims, 6 Drawing Sheets

U.S. PATENT DOCUMENTS

| | | | | |
|---|---|---|---|---|
| 2009/0017740 | A1* | 1/2009 | Oie et al. | 453/58 |
| 2009/0171498 | A1* | 7/2009 | Tabata et al. | 700/214 |

FOREIGN PATENT DOCUMENTS

| | | |
|---|---|---|
| JP | 7-21439 | 1/1995 |
| JP | 9-288756 | 11/1997 |
| JP | 10-188069 | 7/1998 |
| JP | 11-250314 | 9/1999 |
| JP | 2000-76517 | 3/2000 |
| JP | 2003-337969 | 11/2003 |

* cited by examiner

COIN-ROLL STORAGE

FIELD OF THE INVENTION

The present invention relates to a coin-roll (a roll of coins) storage adapted for storing therein coin rolls (or packages each prepared by collecting and wrapping a predetermined number of coins of the same denomination into a bar-like shape) and controlling a total amount of money of the coin rolls present in the coin-roll storage. In particular, this invention relates to the coin-roll storage adapted for storing therein the coin rolls of Japan as well as those of other various countries and controlling the total amount of such coin rolls present in the coin-roll storage.

BACKGROUND ART

Conventionally, the coin-roll storage adapted for storing each coin roll in a particular storage portion, for each denomination, and controlling the total amount of money of the coin rolls present in the storage has been known. As the coin-roll storage, for example, those disclosed in JP11-250314A have been known.

The coin-roll storage described in JP11-250314A is configured to successively determine the denomination of each coin roll stored in a cassette adapted for storing therein a plurality of coin rolls, while the cassette is contained in a storage body. More specifically, in the storage body of the coin-roll storage, a reflection-type optical sensor is provided, which is configured to be moved in a predetermined direction or along an arrangement direction of the coin rolls stored in the cassette. Based on changes with time of an output of the sensor associated with such movement, the coin-roll storage will determine the denomination from an outer diameter or the like factor of each coin roll.

SUMMARY OF THE INVENTION

However, in the conventional coin-roll storage as described above, there are problems as follows.

Namely, the determination of the denomination takes much time because it is necessary to detect the denomination by moving the sensor as described above, once the cassette storing the coin rolls therein is contained in the storage body.

In addition, an additional mechanism for moving the sensor at a predetermined speed should be required. This is also disadvantageous for the production cost. Furthermore, if attempting to determine each denomination of the coin rolls for a plurality of cassettes, there should be a need for performing the detection by using the sensor while moving it for each cassette. Such an operation should take more time, thus further raising the production cost.

Moreover, the conventional coin-roll storage as described above is configured to store each coin roll in a particular storage portion for each denomination, and the coin rolls to be stored in the coin-roll storage are limited to those of Japan. Namely, in such a conventional coin-roll storage, each storage position is set, in advance, for one-yen coin rolls, five-yen coin rolls, ten-yen coin rolls, fifty-yen coin rolls, hundred-yen coin rolls and five-hundred-yen coin rolls. Accordingly, each storage portion of the cassette is shaped to receive only the coin roll of a particular denomination. Therefore, in such a case that the comparative numbers of the coin rolls of each denomination to be stored in the coin-roll storage becomes too unbalanced, efficiency of storing the coin rolls in the coin-roll storage should be significantly deteriorated. Furthermore, if attempting to store the coin rolls of various denominations of money of various countries in the world, there should be a need for developing and producing the cassettes, corresponding to each related country, and as such increasing the production cost.

The present invention was made in light of such circumstances, and it is therefore an object of this invention to provide a new coin-roll storage, which can accurately determine, in a shorter time, each denomination of the coin rolls stored in a plurality of coin-roll storage portions provided in a coin-roll drawer and substantially reduce the production cost. Furthermore, this coin-roll storage can store therein the Japanese coin rolls of various denominations of money as well as the coin rolls of other various countries in the world, while providing more efficient storage of the coin rolls even in the case in which the comparative numbers of the coin rolls of each denomination to be stored becomes too unbalanced.

The coin-roll storage according to the present invention comprises: a storage body; a coin-roll drawer, which is provided to the coin-roll storage body, such that it can be drawn out, by hand, in a horizontal longitudinal direction, at least between a closing position and a drawing out position, and which has a plurality of coin-roll storage portions provided therein, the coin-roll storage portions being adapted for storing therein coin rolls of various denominations of money, one coin roll for each coin-roll storage portion, with an axis of each coin roll being oriented in a lateral direction, wherein each coin-roll storage portion is configured to store therein the coin roll of any denomination; a displacement detection unit adapted for detecting longitudinal displacement of the coin-roll drawer relative to the storage body; a coin-roll diameter detection unit attached to the storage body and adapted for measuring an outer diameter of the coin roll received in each coin-roll storage portion of the coin-roll drawer; a coin-roll length detection unit attached to the storage body and adapted for measuring an axial length of the coin roll received in each coin-roll storage portion of the coin-roll drawer; a coin-roll material detection unit attached to the storage body and adapted for detecting material of the coin roll received in each coin-roll storage portion of the coin-roll drawer; and a determination unit adapted for determining presence or absence and the denomination of the coin roll stored in each coin-roll storage portion of the coin-roll drawer, based on the longitudinal displacement of the coin-roll drawer detected by the displacement detection unit, the outer diameter of the coin roll detected by the coin-roll diameter detection unit, the axial length of the coin roll detected by the coin-roll length detection unit, and the material of the coin roll detected by the coin-roll material detection unit.

According to this coin-roll storage, the determination unit determines the presence or absence and denomination of the coin roll stored in each coin-roll storage portion of the coin-roll drawer, based on the longitudinal displacement of the coin-roll drawer detected by the displacement detection unit, the outer diameter, axial length and material of the coin roll detected by the respective detection units. In this manner, by using the longitudinal displacement of the coin-roll drawer, the outer diameter, axial length and material of each coin roll can be accurately specified, without being affected by changes of the speed at which the coin-roll drawer is drawn out/pushed inward by hand, even though such changes of the speed actually occur to some extent.

Therefore, by only drawing out/pushing-in operations of the coin-roll drawer by hand, the denomination of each coin roll stored in the plurality of coin-roll storage portions can be accurately determined in a shorter time. In addition, unlike the prior art, there is no need for providing a mechanism for moving the sensor at a predetermined speed. This can achieve significant reduction of the production cost for the coin-roll storage. In this case, the control of the total amount of money of the coin rolls present in the coin-roll storage can be carried out, in particular, based on determination results obtained upon pushing the coin-roll drawer into the coin-roll storage.

Additionally, according to this coin-roll storage, each coin-roll storage portion of the coin-roll drawer can store therein the coin roll of any denomination, and the denomination of each coin roll can be determined, based on a detection result obtained by detecting the outer diameter, axial length and material of the coin roll. Therefore, unlike the conventional coin-roll storage that can store only the coin rolls of a preset particular denomination in each coin-roll storage portion of the coin-roll drawer, the coin rolls of various denominations of money of Japan as well as the coin rolls of other various countries in the world can be stored together. Namely, the coin rolls of various countries in the world should have various outer diameters, thicknesses and materials, as such the production cost should be increased if attempting to develop and produce the coin-roll drawer corresponding to the coin rolls for each country. However, the coin-roll storage of this invention can detect information necessary for specifying each denomination, such as the outer diameter, axial length and material, for various coin rolls of various countries in the world. Accordingly, the coin rolls of various countries in the world can be stored by using only a single machine. Furthermore, according to this coin-roll storage, the storage of the coin rolls can be performed efficiently, even in the case in which the comparative numbers of the coin rolls of each denomination to be stored becomes considerably unbalanced.

In the coin-roll storage according to this invention, it is preferred that the coin-roll length detection unit has a line sensor fixed to the storage body and extending along the lateral direction. Additionally, it is preferred that the coin-roll material detection unit has a magnetic sensor fixed to the storage body.

In the coin-roll storage according to this invention, it is preferred that each coin-roll storage portion of the coin-roll drawer has a cross section of a V-like shape. With such a coin-roll storage, each coin-roll storage portion can securely receive any of the coin rolls of various denominations of money, such as those different in the outer diameter from one another.

In the coin-roll storage according to this invention, it is preferred that a translucent portion is provided to the coin-roll drawer, while extending in the longitudinal direction at least over a region in which the coin-roll storage portions are provided, and that the coin-roll diameter detection unit includes an emission unit and a light receiving unit respectively fixed to the storage body, in positions opposed relative to each other, across the translucent portion of the coin-roll drawer from above and below, and is adapted for outputting a signal, corresponding to presence or absence of blocked light caused by each coin roll.

In the coin-roll storage according to this invention, it is preferred that the coin-roll drawers are provided on a plurality of stages, and that the coin-roll length detection unit and coin-roll material detection unit are respectively provided in plural number, corresponding to the coin-roll drawers on the plurality of stages. With such a coin-roll storage, the axial length and material of each coin roll stored in the coin-roll storage portions of each coin-roll drawer can be securely detected.

In the coin-roll storage according to this invention, it is preferred that a memory unit adapted for storing therein, in advance, correspondence relationships, between each outer diameter, each thickness and material and each denomination, of the coins is further provided; and that the determination unit determines the denomination of the coin roll stored in each coin-roll storage portion of the coin-roll drawer, by using the correspondence relationships stored in the memory unit, and based on the longitudinal displacement of the coin-roll drawer detected by the displacement detection unit, the outer diameter of the coin roll detected by the coin-roll diameter detection unit, the thickness of each coin calculated from the axial length of the coin roll detected by the coin-roll length detection unit, and the material of the coin roll detected by the coin-roll material detection unit.

According to this coin-roll storage, there is no need for preparing or producing the coin-roll drawer, for each country, in order to correspond to the coins of various countries in the world. Instead, by only storing the outer diameter, thickness and material of each coin of various countries in the world into the memory unit, the coin rolls of Japan as well as those of other various countries can be stored together in the coin-roll storage and each total amount of money of such coin rolls can be securely controlled.

DETAILED DESCRIPTION OF THE INVENTION

Hereinafter, one embodiment of the preset invention will be described with reference to the drawings. FIGS. 1 to 8 are provided to illustrate the embodiment of the coin-roll storage according to the present invention and the change complement and control system including this coin-roll storage.

Figure 1:
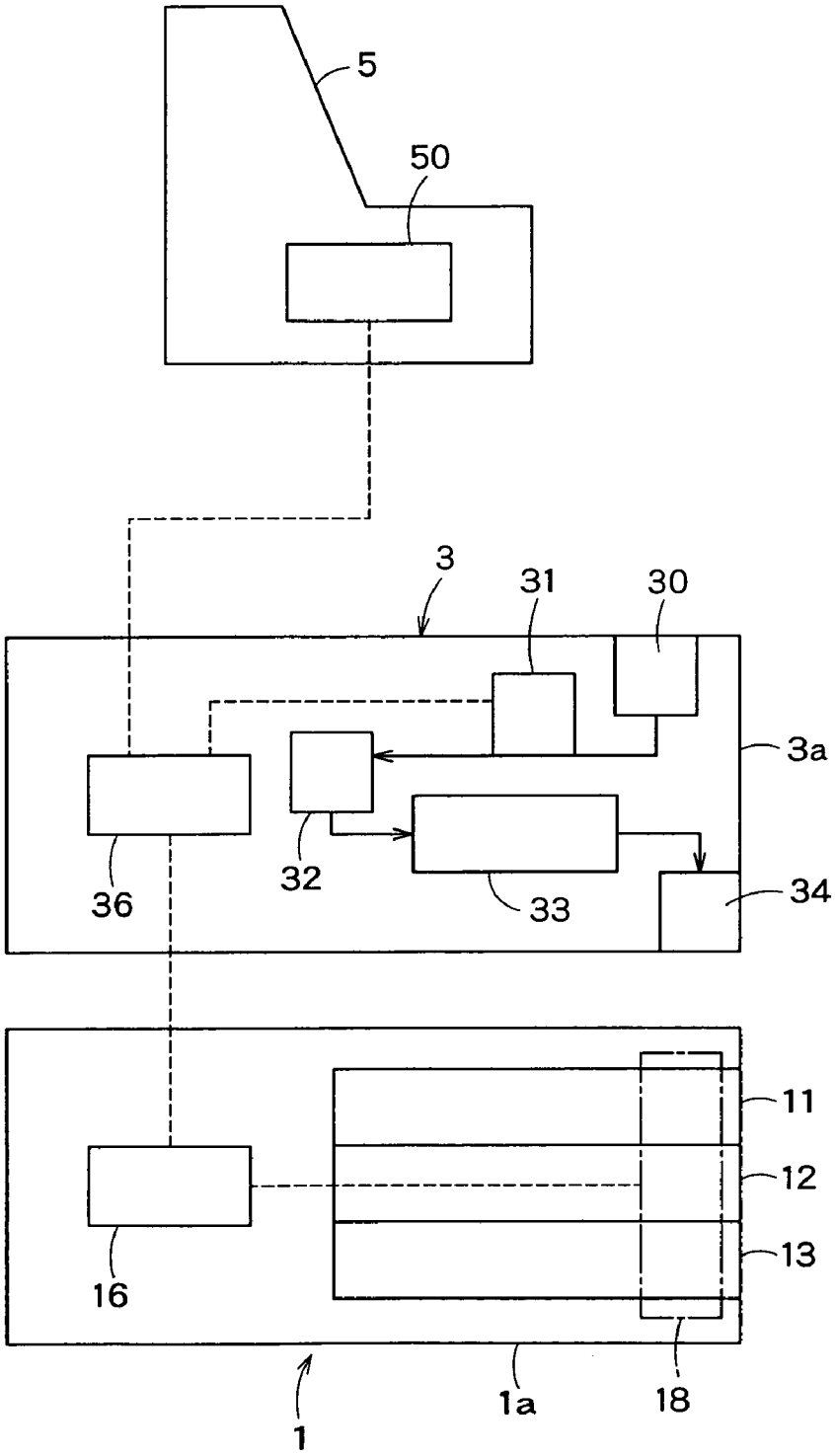
FIG. 1 is a block diagram showing one embodiment of the coin-roll storage according to the present invention, in which the coin-roll storage is incorporated in a change complement and control system.
Figure 2:
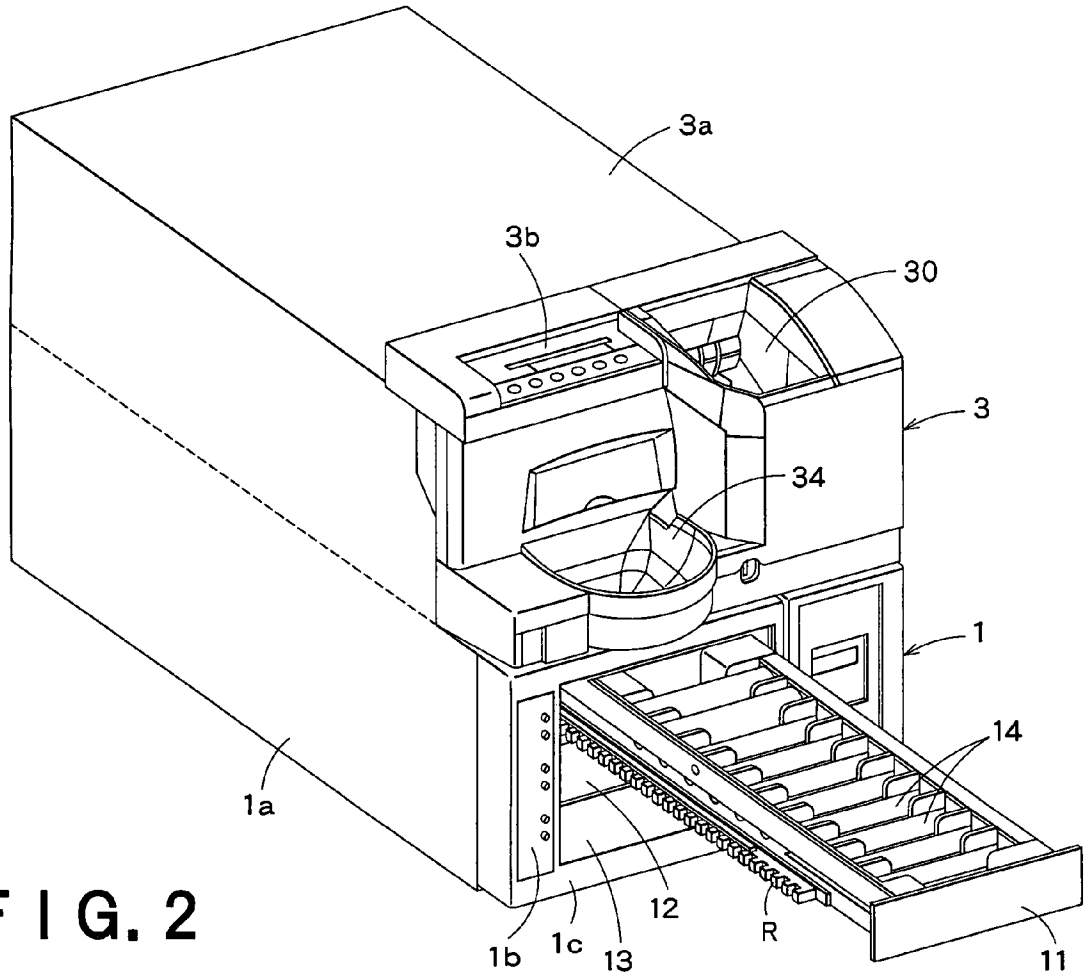
FIG. 2 is a perspective view showing the coin-roll storage and a coin change machine of the system shown in FIG. 1.
Figure 3:
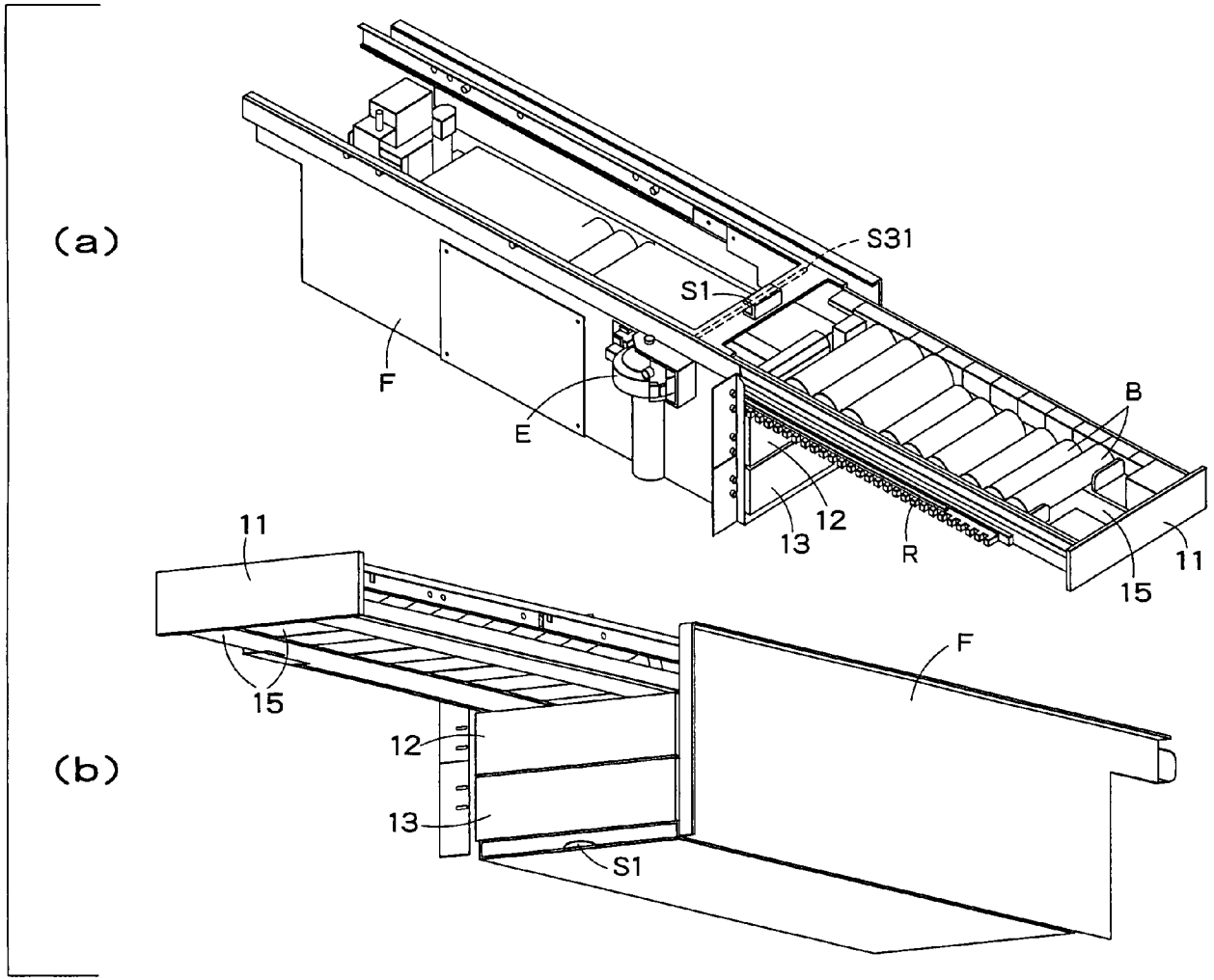
FIG. 3 shows an internal structure of the coin-roll storage shown in FIG. 2, wherein FIG. 3(*a*) is an upper perspective view and FIG. 3(*b*) is a lower perspective view.

Among the drawings, FIG. 1 is a block diagram showing one embodiment of the coin-roll storage according to the present invention, in which the coin-roll storage is incorporated in a change complement and control system, FIG. 2 is a perspective view showing the coin-roll storage and a coin change machine of the system shown in FIG. 1, and FIG. 3 shows an internal structure of the coin-roll storage shown in FIG. 2, wherein FIG. 3(*a*) is an upper perspective view and FIG. 3(*b*) is a lower perspective view.

Figure 4:
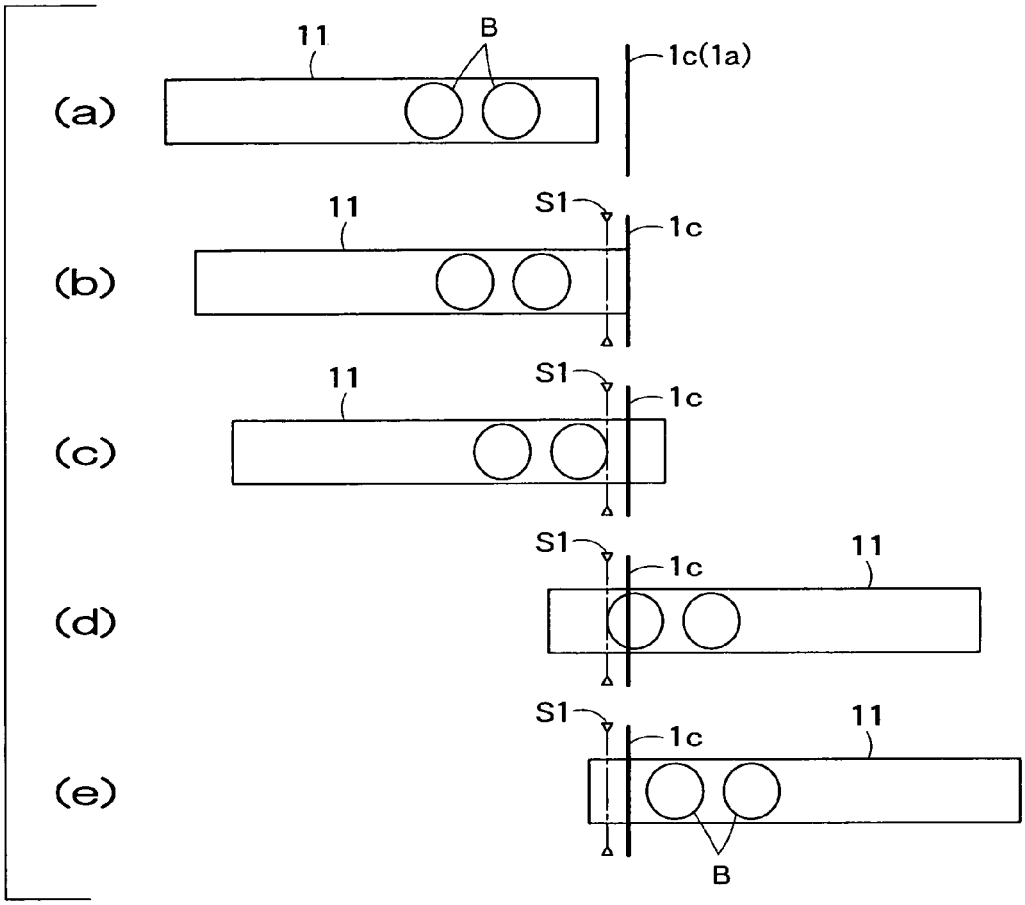
FIG. 4 is a schematic view of displacement of one coin-roll drawer in the coin-roll storage shown in FIG. 2, wherein the drawer is located in (a) a closing position, (b) a pushing-in position, (c) a detection start/end position, (d) a detection end/start position, and (e) a drawing-out position, respectively.
Figure 5:
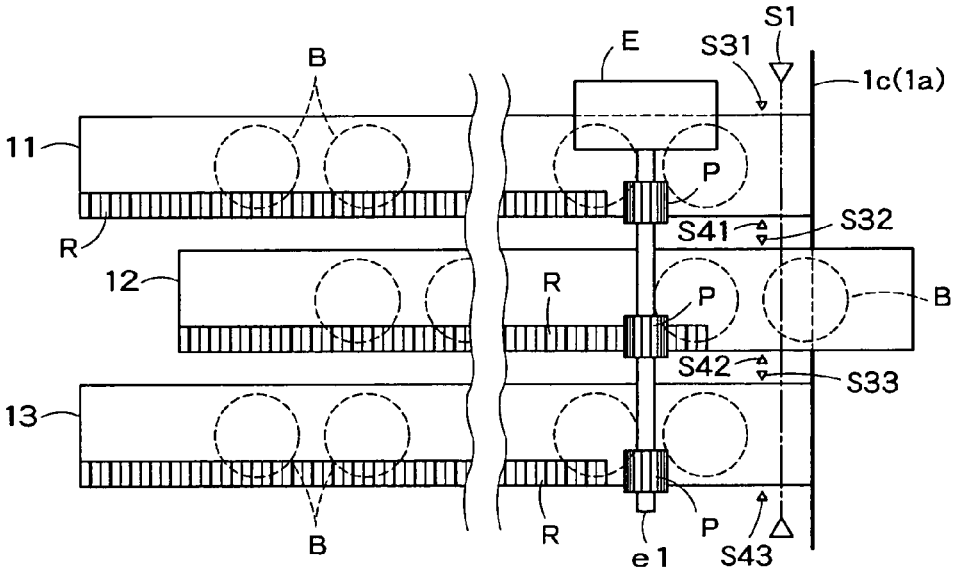
FIG. 5 is a side view schematically showing a relationship between each coin-roll drawer and the displacement detection unit in the coin-roll storage shown in FIG. 2.

FIG. 4 is a schematic view of displacement of one coin-roll drawer in the coin-roll storage shown in FIG. 2, wherein the drawer is located in (a) a closing position, (b) a pushing-in position, (c) a detection start/end position, (d) a detection end/start position, and (e) a drawing-out position, respectively, and FIG. 5 is a side view schematically showing a relationship between each coin-roll drawer and the displacement detection unit in the coin-roll storage shown in FIG. 2.

Figure 6:
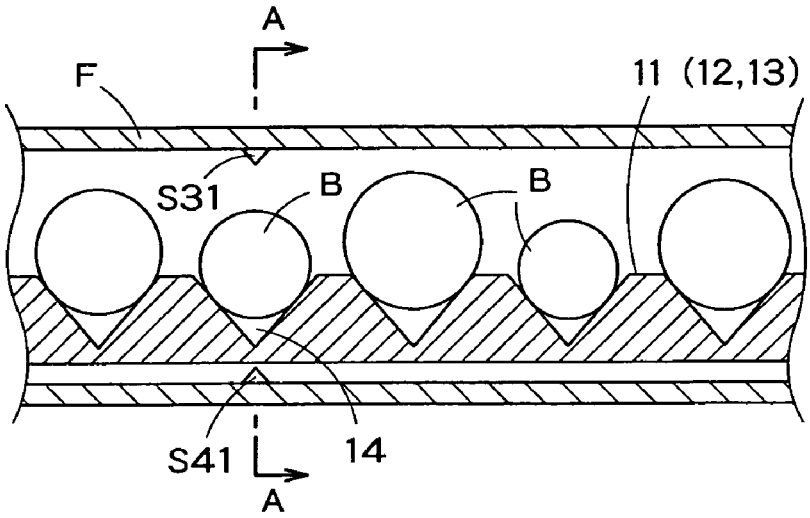
FIG. 6 is a cross section of each coin-roll storage portion of the coin-roll drawer in the coin-roll storage shown in FIG. 2.
Figure 7:
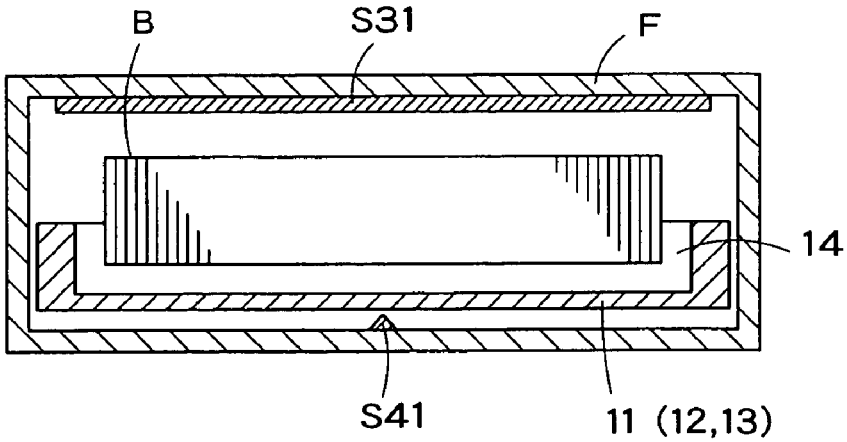
FIG. 7 is a cross section taken along line A-A of FIG. 6.
Figure 8:
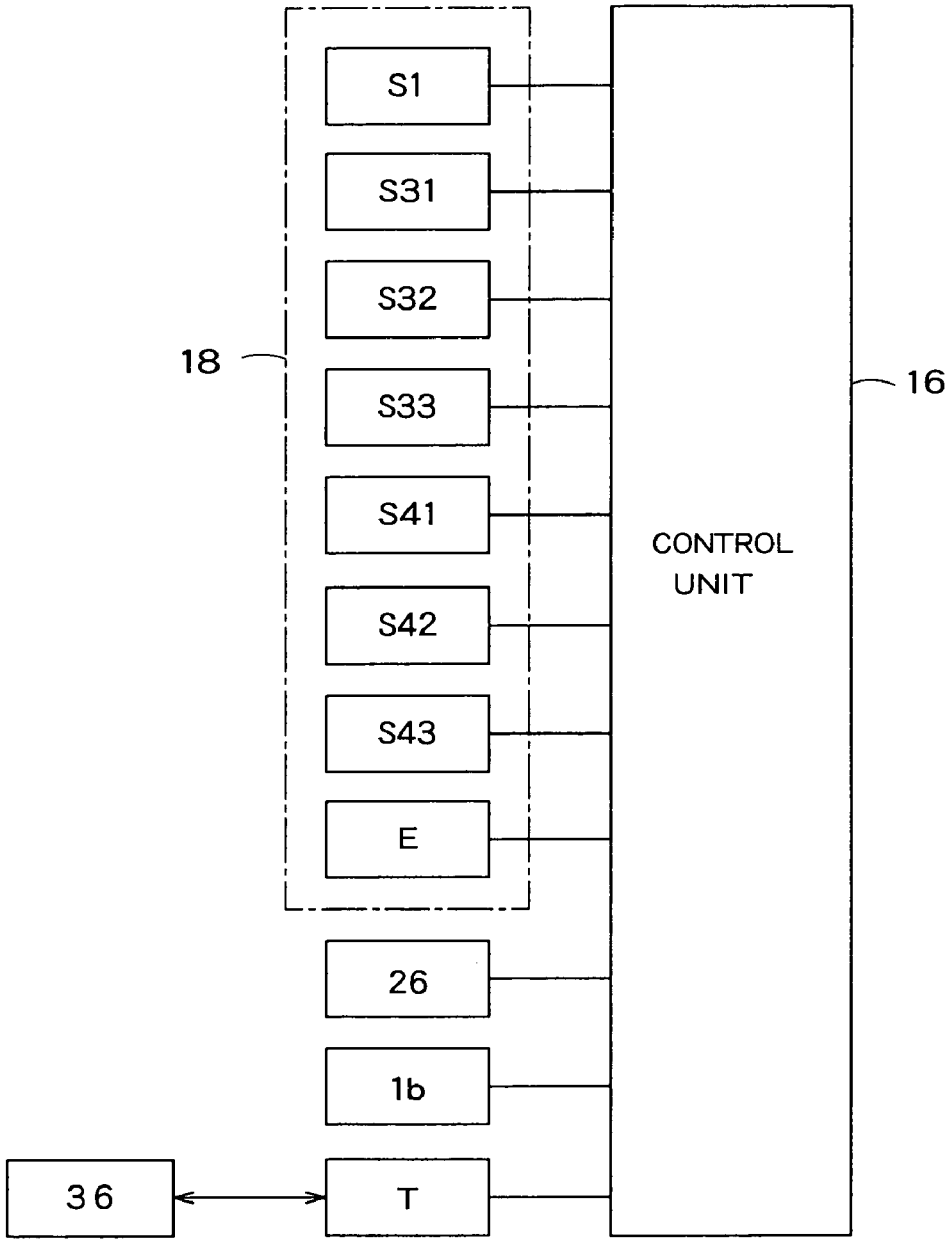
FIG. 8 is a block diagram showing a control system of the coin-roll storage shown in FIG. 2.

FIG. 6 is a cross section of each coin-roll storage portion of the coin-roll drawer in the coin-roll storage shown in FIG. 2, FIG. 7 is a cross section taken along line A-A of FIG. 6, and FIG. 8 is a block diagram showing a control system of the coin-roll storage shown in FIG. 2.

Hereinafter, construction of the change complement and control system including the coin-roll storage of this embodiment, specific construction of the coin-roll storage, construction of the coin change machine incorporated in the system, and effects and modifications of this embodiment will be described, in succession, with reference to FIGS. 1 to 8.

[Construction of the Change Complement and Control System]

As shown in FIG. 1, a coin-roll storage 1 of this embodiment is combined with a coin change machine 3 and a POS (Point-Of-Sale) register (or money register) 5 so as to constitute the change complement and control system. As shown in FIG. 2, the coin-roll storage 1 of this embodiment is integrally combined with the coin change machine 3, such that they are arranged to be adjacent relative to each other. Specifically, a storage body (or case) 1*a* of the coin-roll storage 1 and a case 3*a* of the coin change machine 3 are integrally connected with each other. The POS register 5 is located in the vicinity of the coin change machine 3 and roll-coin storage 1.

As shown in FIG. 1, the coin-roll storage 1, coin change machine 3 and POS register 5 include control units 16, 36, 50, respectively. Among these units, the control unit 16 of the coin-roll storage 1 is communicatively connected to the control unit 36 of the coin change machine 3, while the control unit 36 of the coin change machine 3 is communicatively connected to the control unit 50 of the POS register 5.

[Construction of the Coin-Roll Storage]

As shown in FIGS. 2 and 3, the coin-roll storage 1 includes the storage body 1*a* and three coin-roll drawers 11, 12, 13 each configured to be pulled out forward (in a horizontal longitudinal direction), by hand, relative to the coin-roll storage 1*a*. Each coin-roll drawer 11, 12, 13 is provided with a plurality of coin-roll storage portions 14 (FIG. 2), such that these coin-roll storage portions 14 can store therein the coin-rolls of any denomination, one coin roll for each portion 14. For instance, the coin-rolls may respectively include coins of each denomination of various countries in the world. Upon storing the coin-rolls, each coin-roll storage portion 14 takes a horizontal attitude in which the axis of each coin-roll is oriented in a lateral direction (or transverse direction) that is orthogonal to a drawing direction (or longitudinal direction) of each coin-roll drawer 11, 12, 13.

More specifically, the coin-roll drawer 11 provided on an upper stage, coin-roll drawer 12 on a middle stage and coin-roll drawer 13 on a lower stage have, for example, ten, coin-roll storage portions 14 arranged in a line, respectively. Now, the construction of each coin-roll storage portion 14 will be detailed with reference to FIGS. 6 and 7. As shown in FIG. 6, a cross section of each coin-roll storage portion 14 is of a V-like shape, such that one coin-roll can be stored in a valley portion of the V-like shape. With such a V-like shape in the cross section of each coin-roll storage portion 14 of the respective coin-roll drawers 11, 12, 13, each coin-roll storage portion 14 can receive any of the coin rolls of various denominations of money, such as those different in the outer diameter from one another. Namely, in each coin-roll storage portion 14, any coin roll of the Japanese coin rolls, such as one-yen coin rolls, five-yen coin rolls, ten-yen coin rolls, fifty-yen coin rolls, one-hundred-yen coin rolls and five-hundred-yen coin rolls, as well as the coin rolls of various denominations of money of other countries than Japan, can be stored.

As shown in FIG. 7, a transverse length (i.e., a lateral length in FIG. 7) of each coin-roll storage portion 14 is designed to be greater enough than the axial length of the coin roll, in which, for example, fifty, coins having a thickness that is greatest of the coins of related countries in the world are wrapped into a package. As such, each coin-roll storage portion 14 can securely store therein the coin roll of any denomination used in various countries.

The coin-roll storage 1 includes a detection system 18 (FIG. 1) adapted for outputting a signal for determining presence or absence of each coin roll and its denomination, for each coin-roll storage portion 14 of the coin-roll drawers 11, 12, 13. The control unit 16 of the coin-roll storage 1 serves as a determination unit having a function of determining the presence or absence and denomination of the coin roll stored in each coin-roll storage portion 14 of the particular coin-roll storage drawer 11, 12 or 13, based on the signal outputted from the detection system 18. To a front face of the storage body 1*a* of the coin-roll storage 1, a display panel 1*b* is provided. The display panel 1*b* is adapted for displaying a state of FULL (completely filled) and/or EMPTY (out of stock), in regard to the coin rolls of each denomination, based on a determination result provided from the control unit 16 as the determination unit.

As used herein, each coin roll taken out (usually by a cashier) from the respective coin-roll drawers 11, 12, 13 of the coin-roll storage 1 will be referred to as a "taken-out coin roll."

In FIG. 3, a frame F is shown as provided in the storage body 1*a* (FIG. 2) of the coin-roll storage 1. The frame F is configured to hold each coin-roll drawer 11, 12, 13, such that the drawer can slide in the longitudinal direction. A translucent portion (e.g., an opening or optically transparent portion) 15 is provided at a bottom portion of each coin-roll drawer 11, 12, 13. The translucent portion 15 extends over a region in which the plurality of coin-roll storage portions 14 (FIG. 2) of each coin-roll drawer 11, 12, 13 are arranged, as well as extends up to a position in the vicinity of a distal end of the coin-roll drawer across the forefront coin-roll storage portion 14. As is also shown in FIG. 5, a rack R extending in the longitudinal direction is provided on a left side of each coin-roll drawer 11, 12, 13.

In FIG. 4, one coin-roll drawer 11, as a representative of the three coin roll drawers 11, 12, 13, is shown as located in various longitudinal positions, on the basis of a front panel 1*c* (see FIG. 2) of the storage body 1*a*.

In FIG. 4,

FIG. 4(*a*) designates a "closing position" in which a front face of the coin-roll drawer 11 is substantially flush with the front panel 1*c;*

FIG. 4(*b*) expresses a "pushing-in position" in which the coin-roll drawer 11 is further pushed inward from the closing position, and the front face of the coin-roll drawer 11 is positioned slightly inside from the front panel 1*c;*

FIG. 4(*c*) designates a "detection start/end position" in which detection due to the detection system 18 (FIG. 1) is started when the coin-roll drawer 11 is drawn out, while the detection due to the detection system 18 is ended when the coin-roll drawer 11 is pushed inward;

FIG. 4(*d*) expresses a "detection end/start position" in which the detection due to the detection system 18 is ended when the coin-roll drawer 11 is drawn out, while the detection due to the detection system 18 is started when the coin-roll drawer 11 is pushed inward; and FIG. 4(*e*) designates a "drawing-out position" in which the coin-roll drawer 11 is drawn out such that the coin rolls B can be stored and/or drawn out, for all of the coin-roll storage portions 14 (FIG. 2) of the coin-roller drawer 11.

As is also shown in FIG. 4, a coin-roll diameter sensor S1 that is a representative of the detection system 18 (FIG. 1) is provided.

As shown in FIG. 3, one coin-roll diameter sensor S1 is provided at a front portion of the frame F. Furthermore, as shown in FIG. 3 and FIGS. 5 to 7, a plurality of (e.g., three) coin-roll length sensors S31, S32, S33 and a plurality of (e.g., three) coin-roll material sensors S41, S42, S43 are provided at the front portions of the frame F, respectively corresponding to the coin-roll drawers 11, 12, 13.

The coin-roll diameter sensor S1 has an emission unit and a light receiving unit respectively fixed to the frame F (or storage body 1*a*), in positions opposed relative to each other, across the translucent portions 15 of the three coin-roll drawers 11, 12, 13, from above and below. As shown in FIGS. 4 and 5, the coin-roll diameter sensor S1 is located in such a position that an optical axis of the sensor S1 can pass through a part of the translucent portion 15 in front of the forefront coin-roll storage portion 14 of each coin-roll drawer 11, 12, 13 located in the closing position (FIG. 4(*a*)).

The coin-roll length sensors S31, S32, S33 are provided, respectively corresponding to the coin-roll drawers 11, 12, 13. More specifically, as shown in FIGS. 6 and 7, each coin-roll length sensor S31, S32, S33 has a line sensor fixed to the frame F just above each coin-roll drawer 11, 12, 13. This line sensor, as shown in FIG. 7, is provided to extend along an axial direction of each coin roll when it is stored in each coin-roll storage portion 14. The length of each line sensor is sized to be greater than the longitudinal length of the coin-roll storage portions 14 of each corresponding coin-roll drawer 11, 12, 13. As shown in FIG. 7, both ends of each line sensor are respectively located outward from both ends of the corresponding coin-roll storage portion 14. In this way, each coin-roll length sensor S31, S32, S33 composed of the line sensor can securely detect the axial length of the coin roll located in any position along the longitudinal direction (or lateral direction in FIG. 7) in each coin-roll storage portion 14.

The coin-roll material sensors S41, S42, S43 are also provided, respectively corresponding to the coin-roll drawers 11, 12, 13. Each coin-roll material sensor S41, S42, S43 is adapted to detect a material (e.g., aluminum, brass, nickel or the like) of the coin roll stored in each coin-roll storage portion 14 of each corresponding coin-roll drawer 11, 12, 13. More specifically, as shown in FIGS. 6 and 7, each coin-roll material sensor S41, S42, S43 has a magnetic sensor fixed to the frame F just below each corresponding coin-roll drawer 11, 12, 13.

Additionally, a single two-phase rotary encoder E is provided, on a front left side of the frame F, at a level substantially corresponding to the coin-roll drawer 11 on the upper stage. As shown in FIG. 5, the rotary encoder E has an input axis e1 extending downward. To the input axis e1, three pinions P are fixed, corresponding to the three racks R of the respective coin-roll drawers 11, 12, 13. The rack R of each coin-roll drawer 11, 12, 13 and each corresponding pinion P are positioned, respectively, such that they are meshed with each other at least when the coin-roll drawer 11, 12, 13 is located between the detection start/end position (FIG. 4(*c*)) and the detection end/start position (FIG. 4(*d*)) (or located in a position, within a range necessary for the determination due to the determination unit, between the closing position (FIG. 4(*a*)) and the drawing-out position (FIG. 4(*e*)), while they are not meshed with each other at least when the coin-roll drawer 11, 12, 13 is located in the closing position.

In this case, the rotary encoder E is configured to output pulse signals in numbers proportional to the longitudinal displacement of each coin-roll drawer 11, 12, 13. Namely, the rotary encoder E, racks R and pinions P as described above constitute together the displacement detection unit adapted for detecting the longitudinal displacement of each coin-roll drawer 11, 12, 13 relative to the storage body 1*a*.

As shown in FIG. 8, the coin-roll diameter sensor S1, coin-roll length sensors S31, S32, S33, coin-roll material sensors S41, S42, S43 and rotary encoder E, constituting together the detection system 18, are connected to the control unit 16, respectively. In addition, the display panel 1*b* (see FIG. 2), a memory (or memory unit) 26 and a communication interface T are connected to the control unit 16, respectively. In the memory 26, correspondence relationships, between each outer diameter, each thickness and material and each denomination, of the coins of Japan as well as those of other various countries in the world, are stored in advance. The communication interface T is provided for communicative connection between the control unit 36 of the coin change machine 3 (FIG. 1) and the control unit 16.

The control unit 16 serves as the determination unit having a function for determining the presence or absence and denomination of the coin rolls stored in each coin-roll storage portion 14 of each coin-roll drawer, based on the longitudinal displacement of either one of the coin-roll drawers 11, 12, 13 specified from the output of the rotary encoder E as well as on each output of the coin-roll diameter sensor S1, the coin-roll length sensors S31, S32, S33 and coin-roll material sensors S41, S42, S43.

Specifically, upon drawing out one coin-roll drawer from the storage body 1*a* by hand, or upon pushing it into the storage body 1*a* by hand, the rotary encoder E, coin-roll diameter sensor S1, coin-roll length sensors S31, S32, S33 and coin-roll material sensors S41, S42, S43 will output pulse signals, respectively. Among these output signals, the displacement in the longitudinal direction of each coin-roll drawer 11, 12, 13 relative to the storage body 1*a* can be specified by the pulse signal of the rotary encoder E, and as such the longitudinal displacement of each coin-roll storage portion 14 relative to each coin-roll sensor S1; S31, S32, S33; S41, S42, S43 can also be specified. In addition, a transition between transmitted light/blocked light (or presence or absence of the blocked light) caused by a radial outer periphery of each coin roll can be specified by the pulse signals of the coin-roll diameter sensor S1 and coin-roll length sensors S31, S32, S33. Furthermore, the material of each coin roll can be specified by the pulse signals of each coin-roll material sensor S41, S42, S43.

In this way, the presence or absence of each coin roll B as well as the outer diameter, axial length and material of the coin roll B can be specified, for each coin-roll storage portion 14 of the particular coin-roll drawer 11, 12 or 13. Based on such information, the control unit 16 can determine the denomination of each coin roll stored in each coin-roll storage portion 14 of the coin-roll drawers 11, 12, 13, by using the correspondence relationships, between each outer diameter, each thickness and material and each denomination, of the coins of various countries.

[Construction of the Coin Change Machine]

As shown in FIGS. 1 and 2, the coin change machine 3 is provided with an insertion slot 30, a disbursing slot 34 and a display and operation panel 3*b* (FIG. 2), in a front face of the case 3*a*. Additionally, as shown in FIG. 1, the coin change machine 3 includes a discrimination unit 31, a sorting unit 32 and a storage unit 33 for each denomination. The discrimination unit 31 is configured to discriminate the denomination and number of loose coins inserted into the insertion slot 30. The sorting unit 32 is configured to sort the loose coins discriminated by the discrimination unit 31 for each denomination. The storage unit 33 for each denomination is configured to store therein the loose coins sorted by the sorting unit 32 for each denomination.

Thus, the coin change machine 3 is configured to discharge the loose coins stored in the storage unit 33 for each denomination into the disbursing slot 34 in response to a request for disbursing changes or the like. As the loose coins inserted into the insertion slot 30, the coins deposited from each customer are also included, in addition to the coins complemented as the changes (typically, loose coins obtained by unwrapping each package of the taken-out coin roll). Both of such coins are stored in the storage unit 33 for each denomination and then utilized as the changes, without being distinguished in particular.

To the control unit 36 of the coin change machine 3, the determination result is transmitted from the control unit 16 of the coin-roll storage 1. In the case in which the loose coins obtained by unwrapping the package of each taken-out coin roll are inserted into the insertion slot 30, the control unit 36 has a function for comparing the denomination and number of the loose coins discriminated by the discrimination unit 31 with the denomination and number of the taken-out coin rolls based on the transmitted determination result, and then controlling correspondence between these two factors.

For instance, in the case in which the denomination and number of the loose coins are discriminated as ones that do not to correspond to the denomination and number of the taken-out coin rolls (or in the case in which the denomination is the same while the total number of the loose coins is not coincident with the total number of the taken-out coin rolls calculated by multiplying the number of coins (usually fifty) per coin roll by the number of coin rolls), a flag is assigned to log data of the change complement and control system.

Consequently, the correspondence between the taken-out coin rolls and the loose coins complemented as the changes can be accurately controlled. It should be appreciated that the control unit 50 of the POS register 5 may have a function for controlling such correspondence relationships as described above, in place of the control unit 36 of the coin change machine 3.

[Effects]

Next, the effects of the coin-roll storage of this embodiment as constructed above will be described.

According to the coin-roll storage 1 of this embodiment, when the particular coin-roll drawer 11, 12 or 13 is drawn out from or pushed into the storage body 1*a* by hand, the control unit 16 as the determination unit determines the presence or absence and denomination of the coin roll stored in each coin-roll storage portion 14 of the particular coin-roll drawer, based on the longitudinal displacement of the coin-roll drawer 11, 12 or 13 specified from the output of the rotary encoder E as the displacement detection unit, the output of the coin-roll diameter sensor S1 in response to the blocked light caused by the coin roll, and each output of the coin-roll length sensors S31, S32, S33 and coin-roll material sensors S41, S42, S43. In this case, the denomination of the coin roll can be determined, on the basis of the longitudinal displacement of the coin-roll drawer 11, 12 or 13 as well as the outer diameter of the coin roll specified based on the output of the coin-roll diameter sensor S1, the axial length of the coin roll specified based on each output of the coin-roll length sensors S31, S32, S33, and the material of the coin roll specified based on each output of the coin-roll material sensors S41, S42, S43. In this manner, by using the longitudinal displacement of each coin-roll drawer 11, 12, 13, the outer diameter, axial length and material of each coin roll can be accurately specified, without being affected by changes of the speed at which the coin-roll drawer is drawn out/pushed inward by hand, even though such changes of the speed actually occur to some extent.

Therefore, by only pushing the particular coin-roll drawer 11, 12 or 13 inward by hand, the denomination of each coin roll stored in the plurality of coin-roll storage portions 14 of the coin-roll drawer can be accurately determined in a shorter time, as such performing the control of the total amount of money of the coin rolls present in the coin-roll storage. In addition, this embodiment can eliminate the need for providing the mechanism as described in the prior art, which is required for moving the sensor at a predetermined speed. Therefore, the production cost for the coin-roll storage can be significantly reduced.

Furthermore, each longitudinal displacement of the plurality of coin-roll drawers 11, 12, 13 can be detected by the single rotary encoder E. Thus, the production cost required for the displacement detection unit can be substantially saved, as such further reducing the production cost for the entire coin-storage.

Additionally, according to the coin-roll storage 1 of this embodiment, the coin roll of any denomination can be stored in each coin-roll storage portion 14 of the coin-roll drawers 11, 12, 13, and the denomination of each coin roll can be determined, based on a detection result obtained by detecting the outer diameter, axial length and material of the coin roll. Therefore, unlike the coin-roll storage configured such that each coin-roll storage portion of the coin-roll drawers can store only the coin rolls of a particular denomination, the coin-roll storage 1 of this embodiment can store therein the coin rolls of each denomination of Japan as well as various coin rolls of other countries in the world. Namely, in the coins of various countries in the world, there are various differences in the outer diameter, thickness and material. If developing and producing the coin-roll drawers corresponding to such differences of the coins for each country, the production cost should be significantly increased. However, with the coin-roll storage 1 of this embodiment, information on factors, such as the outer diameter, axial length and material of each coin roll, necessary for specifying each denomination of the coins of various related countries in the world can be optionally detected. Therefore, the coin rolls of such various related countries in the world can be handled and/or controlled by only the single machine. In addition, according to the coin-roll storage 1 as described above, the storage of the coin rolls can be performed effectively even in the case in which the comparative numbers of the coin rolls of each denomination to be stored therein becomes too unbalanced.

Because each coin-roll storage portion 14 of the coin-roll drawers 11, 12, 13 has a cross section of a V-like shape, such a coin-roll storage portion 14 can securely receive each coin roll of a plurality of denominations of money, such as those having different outer diameters from one another.

The coin-roll drawers 11, 12, 13 are arranged on a plurality of stages, and the coin-roll length sensors S31, S32, S33 and coin-roll material sensors S41, S42, S43 are respectively provided in plural number, corresponding to the coin-roll drawers 11, 12, 13 on the plurality of stages. Therefore, the axial length and material of the coin roll stored in each coin-roll storage portion 14 of the respective coin-roll drawers 11, 12, 13 can be securely detected.

Additionally, the memory 26 is provided, which is adapted for storing therein, in advance, the correspondence relationships, between each outer diameter, each thickness and material and each denomination, of the coins of various countries in the world. Accordingly, by utilizing such correspondence relationships stored in the memory 26, the denomination of each coin roll can be determined, based on the outer diameter, axial length and material of the coin roll detected by each sensor. According to this coin-roll storage 1, there should be no need for producing the coin roll drawer for each country in order to correspond to each coin roll of various related countries. Instead, by only using the memory 26 adapted for storing therein the outer diameter, thickness and material of each coin roll of such various countries, the coin-roll storage 1 can store therein the coin rolls of Japan as well as those of other various countries and control the total amount of money of the coin rolls present in the coin-roll storage 1.

[Modifications]

The coin-roll storage 1 according to this embodiment is not limited to the aspect as described above, but may be added with various modifications without departing from the scope of this invention.

For instance, in the aspect described above, the control unit 16 of the coin-roll storage 1 has been described as one that can serve as the determination unit. Instead, the control unit 36 of the coin change machine 3 and/or control unit 50 of the POS register 5 may have a function as the determination unit.

Each pinion P has been described as one fixed to the input axis e1 of the rotary encoder E. However, the pinion P may not be fixed to the input axis e1, provided that it can be rotated together with the input axis e1. For instance, an additional gear or axis may be provided between each pinion P and the input axis e1.

Additionally, each coin-roll length sensor S31, S32, S33 attached to the storage body 1*a* may be another sensor than the line sensor, provided that it can detect the axial length of each coin roll. Similarly, each coin-roll material sensor S41, S42, S43 attached to the storage body 1*a* may be another sensor than the magnetic sensor, provided that it can detect the material of each coin roll.

Furthermore, each coin-roll storage portion 14 of the respective coin-roll drawers 11, 12, 13 is not limited to one having the V-shaped cross section. For instance, the cross section of each successively arranged coin-roll storage portion 14 may be of a wave-like shape, such that it can store each coin roll in a valley portion of such a wave-like shape.

The invention claimed is:

1. A coin-roll storage, comprising:

a storage body;

a coin-roll drawer, which is provided to the coin-roll storage body, such that it can be drawn out, by hand, in a horizontal longitudinal direction, at least between a closing position and a drawing out position, and which has a plurality of coin-roll storage portions provided therein, the coin-roll storage portions being adapted for storing therein coin rolls of various denominations of money, one coin roll for each coin-roll storage portion, with an axis of each coin roll being oriented in a lateral direction, wherein each coin-roll storage portion is configured to store therein the coin roll of any denomination;

a displacement detection unit adapted for detecting longitudinal displacement of the coin-roll drawer relative to the storage body;

a coin-roll diameter detection unit attached to the storage body and adapted for measuring an outer diameter of the coin roll received in each coin-roll storage portion of the coin-roll drawer;

a coin-roll length detection unit attached to the storage body and adapted for measuring an axial length of the coin roll received in each coin-roll storage portion of the coin-roll drawer;

a coin-roll material detection unit attached to the storage body and adapted for detecting material of the coin roll received in each coin-roll storage portion of the coin-roll drawer; and a determination unit adapted for determining presence or absence and the denomination of the coin roll stored in each coin-roll storage portion of the coin-roll drawer, based on the longitudinal displacement of the coin-roll drawer detected by the displacement detection unit, the outer diameter of the coin roll detected by the coin-roll diameter detection unit, the axial length of the coin roll detected by the coin-roll length detection unit, and the material of the coin roll detected by the coin-roll material detection unit.

2. The coin-roll storage according to claim 1, wherein the coin-roll length detection unit has a line sensor fixed to the storage body and extending along the lateral direction.

3. The coin-roll storage according to claim 1, wherein the coin-roll material detection unit has a magnetic sensor fixed to the storage body.

4. The coin-roll storage according to claim 1, wherein each coin-roll storage portion of the coin-roll drawer has a cross section of a V-like shape.

5. The coin-roll storage according to claim 1, wherein a translucent portion is provided to the coin-roll drawer, while extending in the longitudinal direction at least over a region in which the plurality of coin-roll storage portions are provided, and wherein the coin-roll diameter detection unit includes an emission unit and a light receiving unit respectively fixed to the storage body, in positions opposed relative to each other, across the translucent portion of the coin-roll drawer from above and below, and is adapted for outputting a signal, corresponding to presence or absence of blocked light caused by each coin roll.

6. The coin-roll storage according to claim 1, wherein the coin-roll drawers are provided on a plurality of stages; and wherein the coin-roll length detection unit and coin-roll-material detection unit are respectively provided in plural number, respectively corresponding to the coin-roll drawers on the plurality of stages.

7. The coin-roll storage according to claim 1, wherein a memory unit adapted for storing therein, in advance, correspondence relationships, between each outer diameter, each thickness and material and each denomination, of the coins is further provided; and wherein the determination unit determines the denomination of the coin roll stored in each coin-roll storage portion of the coin-roll drawer, by using the correspondence relationships stored in the memory unit, and based on the longitudinal displacement of the coin-roll drawer detected by the displacement detection unit, the outer diameter of the coin roll detected by the coin-roll diameter detection unit, the thickness of each coin calculated from the axial length of the coin roll detected by the coin-roll length detection unit, and the material of the coin roll detected by the coin-roll material detection unit.

* * * * *